US005261655A

United States Patent [19]

Keller et al.

[11] Patent Number: 5,261,655

[45] Date of Patent: Nov. 16, 1993

[54] DISK STACKER WITH INTERMITTENT CORRUGATION ASSISTANCE FOR SMALL SHEETS

[75] Inventors: Paul D. Keller, Webster; Elizabeth D. Fox, Rochester, both of N.Y.

[73] Assignee: Xerox Corporation, Stamford, Conn.

[21] Appl. No.: 997,053

[22] Filed: Dec. 28, 1992

[51] Int. Cl.[5] ..... B65H 29/00

[52] U.S. Cl. ..... 271/187; 271/315

[58] Field of Search ..... 271/187, 315

[56] References Cited

U.S. PATENT DOCUMENTS

| | | | |
|---|---|---|---|
| 3,851,773 | 12/1974 | Kluge et al. | 271/315 |
| 3,968,960 | 7/1976 | Fedor et al. | 271/187 |
| 4,120,491 | 10/1978 | Lang | 271/187 |
| 4,252,309 | 2/1981 | Garrison et al. | 271/186 |
| 4,431,177 | 2/1984 | Beery et al. | 271/186 |
| 4,431,178 | 2/1984 | Kokubo et al. | 271/187 |
| 4,501,418 | 2/1985 | Ariga et al. | 271/187 |
| 4,522,387 | 6/1985 | Leuthold | 271/187 |
| 4,600,186 | 7/1986 | von Hein et al. | 271/187 |
| 4,770,405 | 9/1988 | Fukushima et al. | 271/187 |
| 4,834,361 | 5/1989 | Fenske et al. | 271/187 |
| 5,065,996 | 11/1991 | McGraw et al. | 271/187 |
| 5,114,135 | 5/1992 | Evangelista et al. | 271/187 |
| 5,145,167 | 9/1992 | McGraw et al. | 271/187 |
| 5,153,663 | 10/1992 | Bober et al. | 355/319 |
| 5,172,904 | 12/1992 | Sze et al. | 271/187 |

FOREIGN PATENT DOCUMENTS 59-203052 11/1984 Japan .

*Primary Examiner*—H. Grant Skaggs

[57] ABSTRACT

An improved sheet stacking apparatus for stacking a wide variety of sheets, especially small sheets, using a rotatable disk stacking unit that receives each sheet in slots defined by fingers on the disks and rotates to invert the sheets. Closely adjacent fixed axis corrugating frictional drive rollers engage the trail edge area of the sheet by the rotation of variable radius disks to larger radius areas thereof which interdigitate with these fixed drive rollers, so that the trail edges of sheets being inverted by the disk contact and are driven by the corrugating rollers. The periphery of the frictional drive rollers is inside of the maximum radius of the disk stacking unit and outside of its minimum radius, so as to be only intermittently interdigitated therewith.

5 Claims, 5 Drawing Sheets

DISK STACKER WITH INTERMITTENT CORRUGATION ASSISTANCE FOR SMALL SHEETS

This is an improvement in sheet disk stackers (inverter/stackers) such as are disclosed in, for example, Xerox Corporation U.S. Pat. Nos. 5,058,880; 5,065,996; and 5,114,135; U.S. Pat. No. 5,145,167, issued Sep. 8, 1992, entitled "Disk Stacker Including Trail Edge Transport Belt for Stacking Short and Long Sheets", filed Aug. 17, 1990 by Thomas C. McGraw, et al.; and allowed Xerox Corporation U.S. Ser. No. 07/758,989, filed Sep. 10, 1991, to Sze, et al., now U.S. Pat. No. 5,172,904. Of these, said U.S. Pat. No. 5,114,135 is of particular interest re foam roller 116 and Col. 15, lines 3–33 and Col. 17, lines 13–23.

References cited in said disk stacker patents [and some of their features] include: U.S. Pat. No. 4,522,387 (conveyor belts 2 re disks 5 in FIG. 1); Japanese Application No. 59-203052 (belt 12 re impeller 21); and U.S. Pat. No. 3,968,960; 4,501,418; and 4,252,309 (variable diameter flipper rollers 6 re feed rollers 7).

Disk stackers desirably provide combined sheet inversion and stacking with sheet control in a small area. The incoming sheet lead edge area is captured temporarily in a slot in a rotating disk system which flips the sheet over, and at the same time, guides the sheet lead edge down onto the stack. Inverted sheet stacking allows for facedown versus faceup stacking, which can be desirable for forward or 1 to N order printing, collated stacking and other applications.

By way of further background re sheet feeder/corrugators, per se, there is noted Xerox Corporation U.S. Pat. No. 5,153,663, issued Oct. 6, 1992 to Henry T. Bober, et al., entitled "Printing Apparatus Employing a compliant Sheet Corrugating Device".

This invention relates generally to an improved system for sequentially inverting and stacking copy sheets into inverted sets; especially, smaller sizes of sheets. Such a stacker is particularly desirable for the sequential copy sheet output of an electrographic printing machine.

In accordance with one disclosed aspect or feature, there is provided here an improved sheet stacking apparatus generally of the disk stacking type capable of stacking sets of a wider variety of copy sheet sizes and weights reliably at high speed with improved, more positive sheet control. The disclosed sheet stacking apparatus includes improved means for more reliably stacking small sheets, especially small, flimsy, light weight, low beam strength sheets, without reducing the reliability of stacking other, larger, sheets, (e.g. letter size, legal size, A-4, B-4, A-3, 11"×17", etc.).

This disclosed system is illustrated in the example herein as an improvement in the disk stacker of the Xerox Corporation "4135" high speed laser printer output module, for improved stacking of small foreign standard size sheets, such as Japanese B5 size sheets, but is not limited thereto.

The disclosed embodiment desirably overcomes small size (especially, Japanese or other foreign standard) sheets stacking problems by desirably intermittently feeding, corrugating and stiffening only the trailing portion (not the lead-in portion) of inverting/stacking sheets; utilizing the variable radius of the intermittently rotating inverting disks juxtaposed with fixed axis corrugation rollers, and thereby not requiring any critical or external camming or solenoid actuations to intermittently engage, corrugate and positively feed forward the trailing (upstream) portion of the small sheet being stacked.

A specific feature of the embodiment disclosed herein is to provide an improved disk-type stacking system in which a disk stacking unit which is intermittently rotatable about an axis of rotation receives the lead edge area of an incoming sheet from an upstream sheet feeder in a sheet entrance path to a stacking area and then partially rotates with the received sheet lead edge area for inverting the sheet for stacking, for which the trail edge area of the sheet must be flipped over, and wherein said disk stacking unit has a variable radius, substantially varying between maximum and minimum radii; the improvement comprising: a driven set of frictional drive rollers on a fixed axis of rotation, said frictional drive rollers being positioned in said sheet entrance path downstream of said upstream sheet feeder, said frictional drive rollers being generally parallel to the axis of rotation of said disk stacking unit, and said frictional drive rollers being positioned relative to said variable radius disk stacking unit for frictionally engaging only the trail edge area of a sheet for feeding the trail edge portion of the sheet forward in said sheet entrance path to assist in the flipping over of the trail edge portion of the sheet after the sheet is no longer in said upstream sheet feeder.

Further specific features provided by the system disclosed herein, individually or in combination, include those wherein the periphery of said frictional drive rollers is inside of said maximum radius of said disk stacking unit and outside of said minimum radius of said disk stacking unit, so as to be only intermittently interdigitated therewith, and/or wherein said disk stacking unit has first peripheral fingers thereon defining sheet entrance slots for said receiving of the lead edge area of an incoming sheet in said disk stacking unit, and wherein said fingers are automatically interposed between said sheet lead edge and said frictional drive rollers during the initial feeding of a sheet lead edge into said sheet entrance slots by said upstream sheet feeder, and/or wherein said disk stacking unit has second peripheral fingers thereon, which, upon the subsequent rotation of said disk unit, underly and lift the trail edge area of that sheet into engagement with said frictional drive rollers, and/or wherein said frictional drive rollers are mounted on a fixed driven shaft overlying said disk stacker unit, and wherein a downwardly inclined trail edge assistance belt transport flight is closely adjacent downstream thereof for cooperation therewith, and wherein said fixed driven shaft also supports and drives said trail edge assistance belt transport.

In the description herein the term "sheet" refers to a usually flimsy sheet of paper, plastic, or other such conventional individual image substrate. The output of "copy sheets", may be abbreviated as the "copy". Related, e.g. page order, plural sheets are referred to as a "set" or "job".

All references cited in this specification, and their references, are incorporated by reference herein where appropriate for appropriate teachings of additional or alternative details, features, and/or technical background. The disclosed apparatus does not require any special control systems or software.

Various of the above-mentioned and further features and advantages will be apparent from the specific apparatus and its operation described in the example below, as well as the claims. Thus, the present invention will be better understood from this description of an embodiment thereof, including the drawing figures (approximately to scale) wherein:

There is illustrated an exemplary feeder/stacker unit or module 10 as disclosed in the cited art. It includes a sheet stacker embodiment 20 modified in accordance with the present invention.

Figure 1:
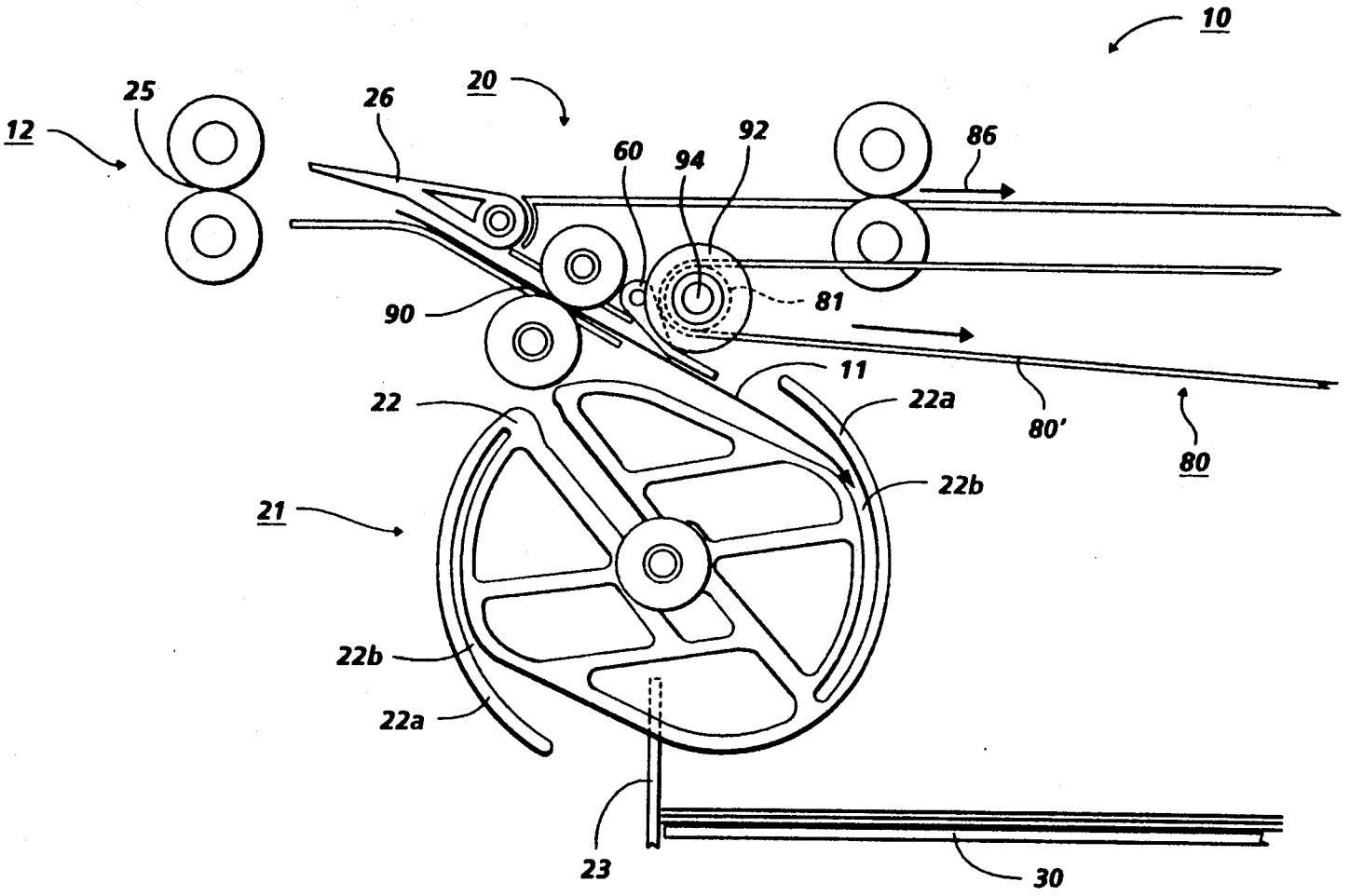
FIG. 1 is an enlarged schematic side view of one embodiment of the subject improved disk stacking system, showing a small sheet entering the system.
Figure 2:
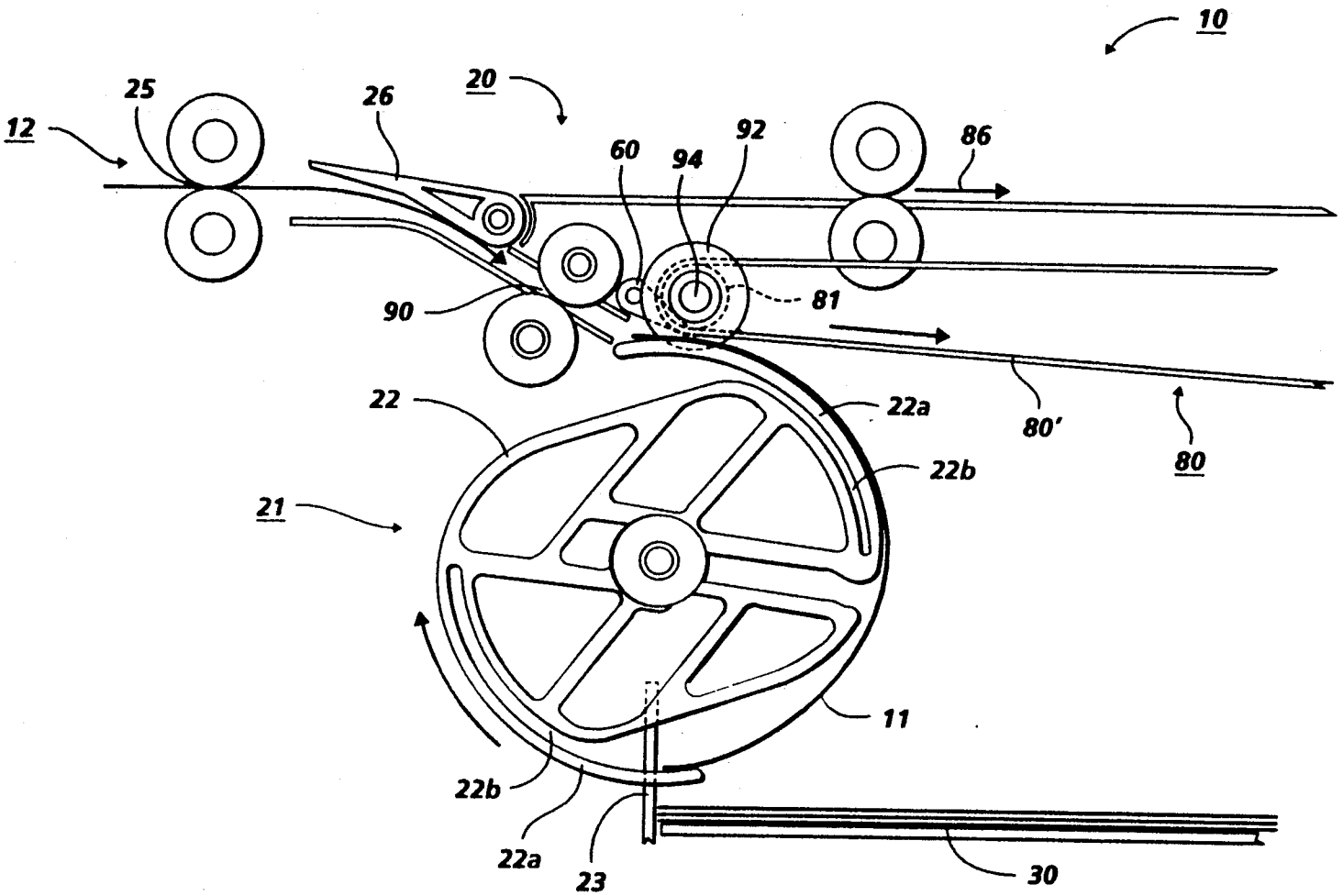
FIG. 2 is the view and embodiment of FIG. 1 shown in the process of stacking a small sheet as the sheet trail end area is about to be inverted.
Figure 3:
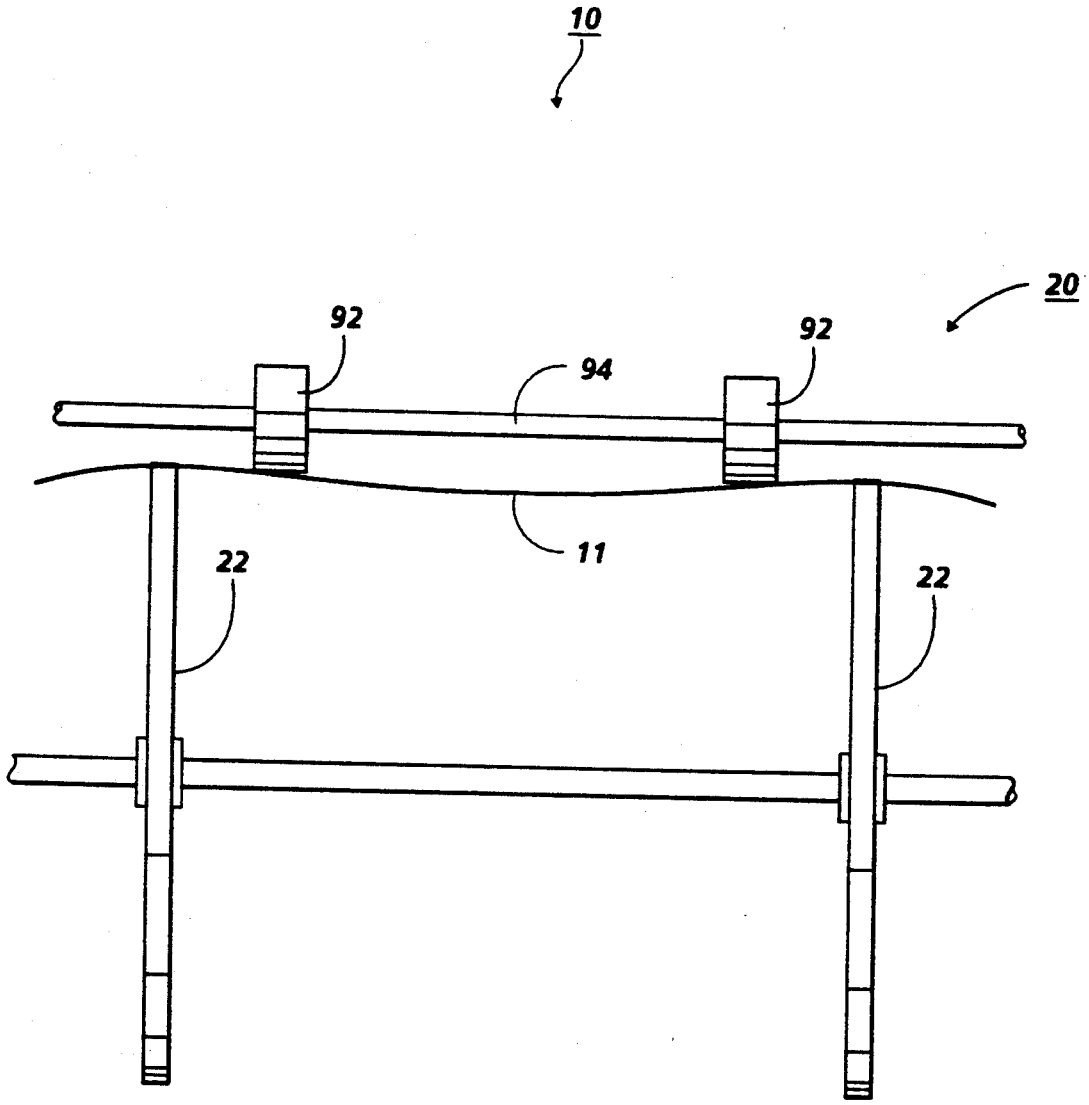
FIG. 3 is a partial right end view of the disk stacker embodiment of FIGS. 1-2 in the position of FIG. 2 in which the trail end area of a small sheet is being corrugated by the disclosed system. [For clarity, rollers 81 and belts 80 are not shown in this view.]
Figure 4:
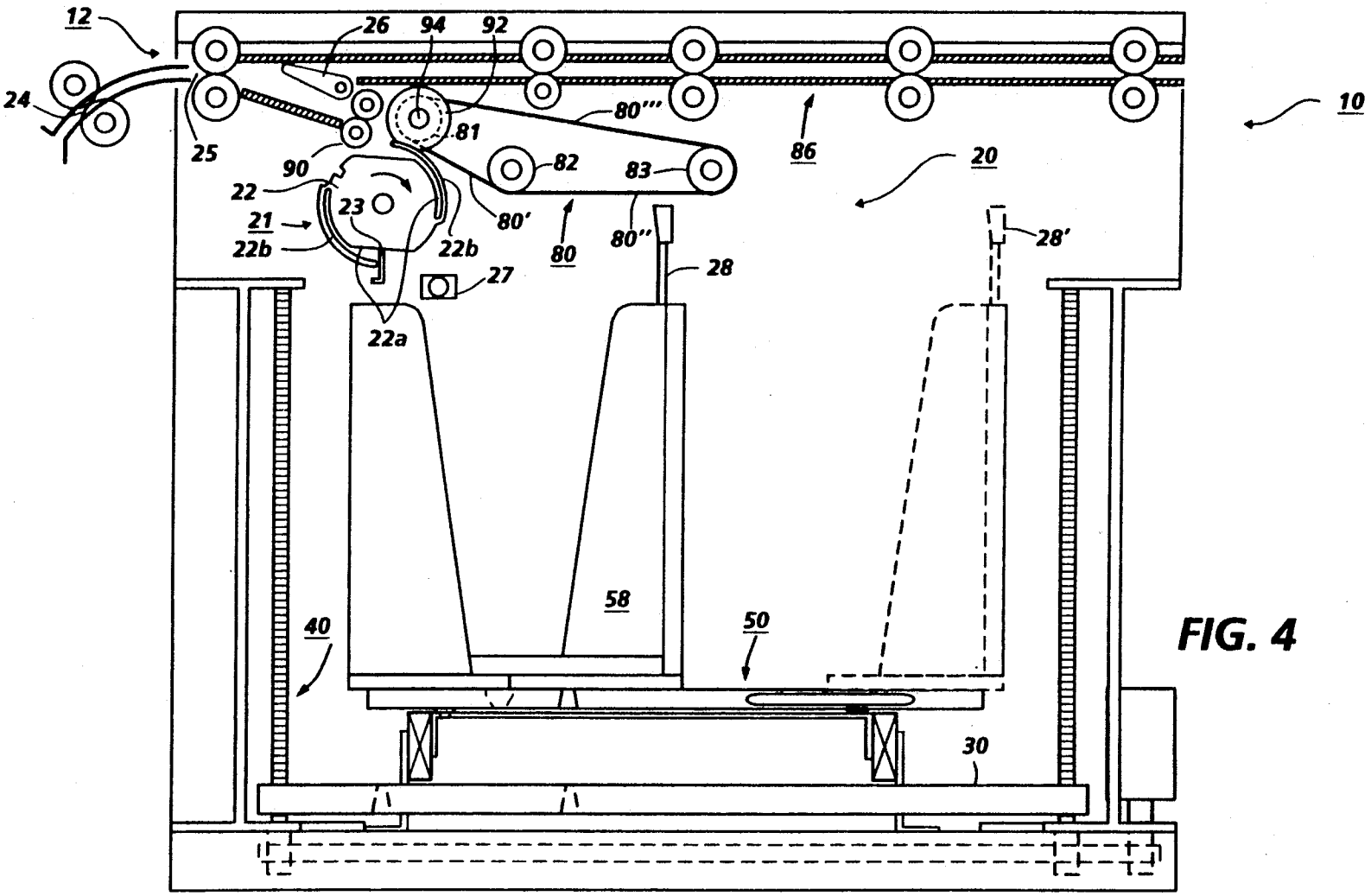
FIG. 4 is an exemplary stacking module incorporating therein the disk stacking system of FIGS. 1-3.
Figure 5:
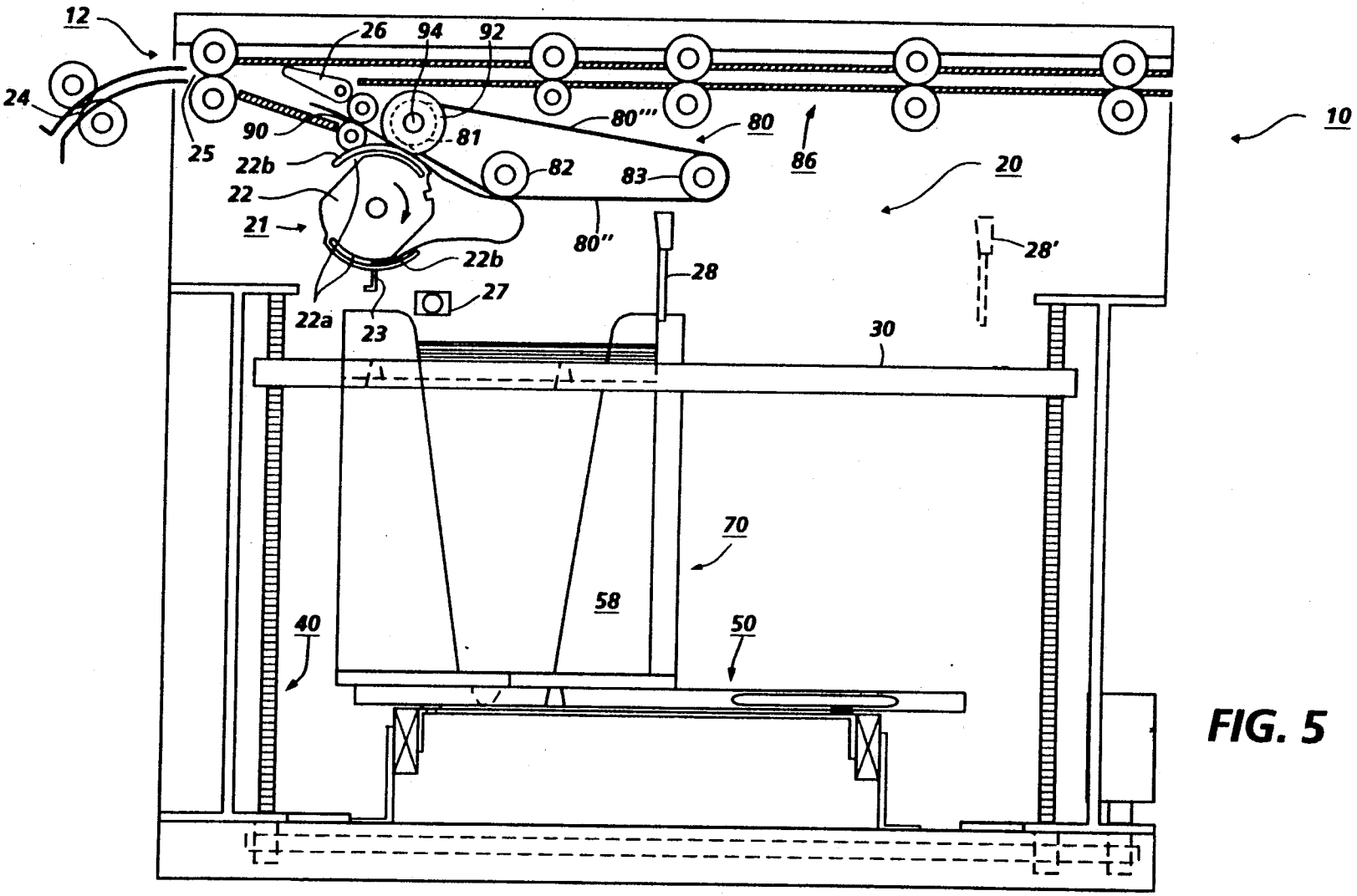
FIG. 5 is the same view as FIG. 4 but shown in the process of stacking a larger sheet.

First, describing the common prior system elements of this example, an input 12 of module 10 and its stacker 20 can be fed sheets 11 from a conventional high speed copier or printer. The disk stacker unit 20 includes a rotating disk inverter unit 21 with plural (at least two) disks 22. Each disk 22 includes two fingers 22*a* defining two arcuate slots 22*b* thereunder for receiving sheets therein. Rotating disk unit 21 rotates approximately 180 degrees after receiving a sheet lead edge area into disk slots 22*b*, to invert the sheet and register the leading edge of the sheet against a registration wall 23 which strips the sheet from the rotatable disks unit 21 as the disks 22 rotate through slots in wall 23. The sheet 11 then drops onto the top of the stack of previously inverted sheets. Here, as shown in FIGS. 4 and 5, the sheet stack is supported on either a main pallet 50 or container pallet 58, both of which are vertically movable by a supporting elevator platform 30. An overhead trail edge assist belt system 80 is preferably located above and adjacent the rotatable disk unit 21, and above the stacking surface, to assist in the inversion of sheets, as will be further described.

Before entering the sheet stacker 20, the sheets exit through output nips such as 24 and 25 of the upstream device. The upstream device could be a printer, copier, another disk stacker module, or a device for rotating sheets. [Sheets may need to be pre-rotated so that they have a desired orientation after being inverted by disk unit 21. The sheets 11 can thereby enter stacker 20 long edge first or short edge first.]

After entering the stacker 20 itself, the sheet 11 here enters a pre-disk sheet transport where the sheet is normally then engaged by the nip formed between one or more pairs of disk stacker input rollers 90. [However, if a bypass signal is provided, upstream bypass deflector gate 26 moves downward to deflect the sheet into a bypass transport 86.] If no bypass signal is provided, the sheet is directed into these disk stacker input rollers 90 for feeding the sheet to an input position of disks unit 21.

The rotational movement of the disks unit 21 can be controlled by a variety of means conventional in the art, such as a stepper motor or cam drive. Preferably, a sheet lead edge sensor located upstream of disks unit 21 detects the presence of a sheet 11 approaching the disks unit. Since the input feeding nip 90 operates at a constant velocity, the time required for the lead edge of the sheet to reach the disk slots 22*b* is known. As the lead edge of the sheet begins to enter the disk slots 22*b*, the disks 22 rotate through a 180° cycle. The disks unit 21 is rotated at a peripheral velocity which is about ½ the velocity of input nip 90, so that the leading edge of the sheet progressively further enters the disk slots 22*b* under disk fingers 22*a*. The disks unit 21 is preferably rotated at an appropriate speed so that the leading edge of the sheet contacts registration wall 23 prior to contacting the end of the slot. This reduces the possibility of damage to the lead edge of the sheet. Such a manner of control is disclosed in Xerox Corporation U.S. Pat. No. 4,431,177 to Beery et al.

Turning now to the the disclosed embodiment of an improvement in this prior disk stacking, added elastomer drive rolls 92 on a driven shaft 94 are positioned over and between the variable radius inverting disks 22. These elastomer drive rolls 92 induce sheet corrugation of the trailing portion of sheets to help drive shorter sheets fully into the stacking zone for complete stacking. This enables stacking of shorter paper and improves reliability for all paper sizes, with little or no increase in stacker cost, with few parts, or even potentially eliminating other parts.

More specifically, mounted here integral the stacker 20 to intermittently interdigitate with disks 22 are the corrugating friction rollers 92 on common drive shaft 94. These driven corrugating rollers 92 are located downstream of the previously final stacker feed-in rollers 90 which drive sheets into the slotted disks of the disk stacker. These corrugating driven rollers 92 assist in driving sheets (in particular, small sized sheets) into the slots 22*b* in the disks 22 after the trail edge of the sheet is released from the nip of the drive rollers 90. The frictional drive rollers 92 are so arranged relative to the disks 22 (which have a variable radius) so that the friction rollers 92 (desirably) do not substantially corrugate or otherwise interfere with the sheet as the sheet is being inserted into slots in the disks. However, the same friction rollers do (desirably) corrugate the trailing portion of the sheet. The friction rollers 92 engage the trailing portion of the sheet by the rotation of the disks unit 21 to the disk position at which the increased disk 22 radius presses the sheet up into the rollers 92. Note that the periphery of rollers 92 is inside the maximum external radius of disks 22, but outside the minimum external radius of disks 22.

The disks 22 may desirably vary in effective peripheral radius from about 5.4 cm (at the fingers 22*a* periphery) to about 4.8 cm at the base of the fingers, to about 3.8 cm in the initial sheet input position of the disks (the smaller radius flat areas betwen fingers 22*a*).

This pre-existing variable shape and geometry of the disks 22 here is used to provide an intermittent drive to the sheet. The sheet lead edge area does not receive a drive force from the corrugating rolls 92, since that portion of the sheet 11 is shielded by the disk fingers 22*a* as the sheet lead edge enters the slots 22*b* under the pair of fingers 22*a*. As the two disks 22 begins to rotate, the mid-section of the sheet also does not receive drive from the corrugation rolls 92 either, due to the smaller (decreased) radius of the external disk surface during that portion of the disk's rotation. As the disks continue to rotate further, the disk radius profile then increases adjacent the corrugation rolls 92 until the peripheral disk surface (now the next set of fingers 22*a*) begins to act as a cam to lift up the trailing portion of the sheet and corrugate that part of the sheet between the fixed axis elastomer rolls 92. The normal force of the larger radius peripheral disk cam surfaces in conjunction with the frictional characteristics of the (interdigitated) rotating elastomer rolls 92 then acts to impart a forward feeding force to the trail area of the sheet, assisting in sheet trail edge flipping motion which enables correct stacking, and prevents short sheets from "hanging up" rather than inverting and stacking.

Another feature here is that the rotating elastomer rolls 92 act in combination with slower moving, or even stopped, disk fingers 22*a*. Unlike traditional corrugation idlers, which rotate with the sheet surface velocity, the disk fingers 22*a* here are desirably either stationary, or moving at a slower speed, relative to the elastomer rolls, at the point in time where they begin to interdigitate and become operative on the sheet. The frictional coefficients of the paper, the elastomer rolls, and the disk material are all system parameters, as well as the speed of the elastomer rolls and the extent or depth of the corrugation engagement, i.e., the disks 22 are preferably nylon or the like so as to be slippery relative to the paper sheets and the elastomer drive rollers 92.

In addition, the disclosed disk 22 radius here is much larger than traditional corrugation idlers. That is providing, in effect, a corrugation "plane" here, instead of only a typical corrugation "point" or "line" engagement supporting the sheet being driven by the frictional drive of the un-nipped frictional drive rollers 92.

This modified system has been found to enable stacking of short process length substrates, like Japanese B5 size sheets, especially 135 kg B5 paper. It effectively meets a particular need to stack Japanese B5 (7.17×10.12 inches or ≈18.2 by 25.7 cm) paper in the Xerox Corporation "4135" high speed printer High Capacity Stacker. The original technology and paper path geometry effectively prevented sheets less than 8 inches (≈20.3 cm) in process length from meeting shutdown rate targets. With the addition of the disclosed driven elastomer corrugation rolls at the illustrated location, the revised High Capacity Stacker exceeded performance targets.

To summarize, novel disclosed aspects include: 1) the use of a larger diameter portion (arc segment) of the external surface of variable diameter inverting disks to provide a variable corrugating normal force against fixed elastomer driven rolls; 2) placement of this elastomer drive in very close proximity to the slot entrance to the disk stacking fingers; and 3) the use of a corrugation drive system that replaces a standard rotating plastic idler with the much larger diameter and stationary or slower moving disk finger.

Further by way of background, under the original design [note patents cited above] sheets entered the disk unit 21 were driven only by the upstream or feed-in rollers 90 pinch nip. After a pre-determined delay, the disk unit 21 began to rotate under control of a stepper motor. Guided by the disk fingers 22*a*, the lead edge of the sheet would contact the registration wall 23, and under the continued drive force of the pinch nip 90, the sheet would begin to arc up against the overlying trail edge assist belts 80. By the time the trail edge exited the pinch nip 90, the trail edge assist belts 80 would have control of the sheet, helping it to flip the trail area of the sheet over onto the stack. For short papers however, this pinch nip 90 was too far upstream and sheets less than 8 inches (≈20.3 cm) process length tended to stall.

Originally, the trail edge of a short sheet could exit the pinch nip 90 before the sheet lead edge contacted the registration wall 23. Since there was then no sheet 11 buckling force, the overlying trail edge assist belts 80 were ineffective in flipping the short sheet.

As was also in the original design, a sheet flattening set of input assistance fingers or plates 60 may be cammed down onto the incoming sheet (downstream of the input rollers 90 nip) for approximately the feeding of the first half of the sheets, and then these fingers 60 are cammed up, as illustrated here, so as to not impede the trailing area of the sheet being stacked. This, however, does not assist the trail edge control. [It may be possible to eliminate fingers 60 altogether with the present system.]

The new design provides at least two elastomer drive rolls 92 placed parallel to and axially between the two disks 22 and driven at a constant velocity. As in the original design, sheets enter the disk fingers 22*a* driven by the upstream pinch nip 90. After a pre-determined delay, as before, the disk unit 21 again begins to rotate under control of a stepper motor or the like. At this point, however, the mechanics change with the new design.

In the new design shown herein, the variable radius external surface of the disks 22 provides a variable normal force which corrugates the trail edge of sheets around the new elastomer drive rolls 92. The high coefficient of friction of the elastomer rolls 92 then drives the trail edge of the sheet forward into the stacking cavity, flipping the trail end over. No longer is the sheet reliant on the upstream pinch nip 90 to buckle the sheet trail edge into the trail edge assist belts 80. In fact, the trail edge assist belts are not even necessary for short sheets.

This expands the capabilities of the system by substantially lowering the paper size limitation in the process (sheet feeding) direction, a significant marketing enhancement. It is projected that this new system may even enable disk stacking of significantly smaller substrates, such as envelopes, for which inverted stacking may also be desirable in some cases. It also has potential to replace present trail edge assisted stacking technology for larger, e.g., 11×17 and A3 sizes.

Referring to FIGS. 4 and 5, elevator platform 30 may be moved vertically by a screw drive 40. The screw drive 40 mechanism here includes separate, vertical, rotatable shafts having a threaded outer surface at each corner of the elevator platform 30 and extending through threaded apertures therein (four vertical shafts in total). As the vertical shafts are rotated by a motor, elevator platform 30 is raised or lowered. A stack height sensor 27 may be used to control the movement of platform 30 so that the top of the stack remains at substantially the same level. Each stacker unit 20 may also includes a side tamping mechanism (not shown here-see cited patents) which is capable of offsetting sets of sheets in a direction perpendicular to the process direction.

For ease of removal of a stack of sheets from the main pallet 50, and for storage, a container pallet 58 may be placed on top of main pallet 50. Container pallet 58 may have projections on the bottom thereof that mate with complimentary openings in main pallet 50. Elevator platform 30 will lift the container pallet 58 into position to receive sheets rather than the main pallet 50. The stacker is emptied by lifting the container pallet off the main pallet. Container pallets may be sized according to the size of sheets to be stacked and projections on the bottom of the container pallets fit into those of the openings in the main pallet as appropriate.

A desired feature of a high speed computer printer is the ability to provide long run capability with very minimal down time due to system failures, lack of paper supply, or lost time during set unloading. By providing more than one stacker module 10, the output need not be interrupted when one of the stackers 20 becomes full or jam since output can be fed to the other stacker. A bypass capability (deflector gate 26 and bypass transport 86) of each stacker unit 10 enables one or both stackers to be bypassed, so that documents can be fed to other downstream devices such as additional stackers or sheet finishing apparatus, such as, for example, folding or stapling devices.

As further shown in the cited patents, an optional stacking trail edge guide 28 may be positioned and movably mounted so that sheets having different lengths can be accommodated in sheet stacker 20.

Another incorporated feature involves the construction and operation of the trail edge assist transport belt 80. [See the above cited U.S. Pat. No. 5,145,167 and co-pending U.S. Pat. No. 5,172,904, in particular]. Here the trail edge assist belt or belts 80 are preferably rotated at a velocity which is greater than the velocity at which the sheet input feeding means (which includes here input nips 24 and 25 and rollers 90) is operated. Preferably, transport belt 80 is rotated at a velocity which is 1.5 times the velocity of the feeding means. Additionally, trail edge transport belt 80 here is arranged at an initial angle to elevator platform 30 so that a distance between a portion 80' of the transport belt 80 and elevator platform 30 decreases as the transport belt 80 extends away from rotatable disk unit 21. As shown in FIGS. 4 and 5, three pulleys 81, 82, and 83, at least one of which is driven by a motor (not shown) maintain tension on transport belt 80 and cause transport belt 80 to rotate at a velocity which is greater than that of the sheet input feeder means.

After the lead edge of a sheet has been inverted by disk unit 21, a sheet has to un-roll its trail edge to finish inverting. Transport belt 80 is intended to be configured and positioned with respect to disk unit 21 to ensure that all normal sized sheets, including lightweight sheets, begin to make contact with the belt 80 while each sheet is being driven by input nip 25. It is desired to cause the sheet to not sag away from the transport belt 80. After the sheet trail edge exits the input nip 25, the sheet's trail edge velocity will be at the direction required to un-roll the sheet, but larger sheets in particular benefit from the continued feeding forward of the sheet 11 trail area by belts 80.

As further disclosed in said U.S. Pat. No. 5,145,167, a set of flexible belts like 80 are rotated near the top of the discs and angled downwardly toward elevator platform 30. The belts assist the sheet to un-roll if the sheet contacts the belts. However, lightweight small sheets do not always have enough process length and beam strength to effectively contact the belts 80. They sag away from the belts and lose velocity at the direction required to un-roll, and therefore can fail to invert their trail edges, causing a mis-stacking sheet jam. The present system particularly addresses this problem.

As discussed in said U.S. Pat. No. 5,172,904, and shown here in FIGS. 4 and 5, additional reliability in handling light weight sheets is obtained by configuring belt 80 such that an initial section 80' thereof is closely spaced with respect to discs 21 and slopes downwardly at a steep angle in the belt span between rollers 81 and 82 as it extends away from disk unit 21. The angle of belt 80' portion here is approximately 17 degrees with respect to a horizontal plane. This configuration facilitates control for the sheet in that a normal sized or larger sheet normally contacts the belt 80 while it is still in final input rollers 90. A continuing second portion 80'' of belt 80 is generally parallel to the top surface of elevator 30, while a third (return) flight or portion of the belt 80''' does not contact the sheets. With this relationship between belt 80 and disk unit 21, better control is maintained over sheets 11 of most sizes and weights because most sheets are forced to contact belt(s) 80 in flight 80' while they are still under the influence of input rollers 90. However, in the present improvement, trail edge corrugating drive rollers 92 make belt(s) 80 much less critical.

As shown, the elastomer drive idler rollers 92 desirably may be mounted on the same shaft 94 as belt 80 drive rollers 81, interdigitated with the rollers 81 and slightly larger in diameter, e.g., 2.25 cm vs. 1.94 cm (including the belts 80 thickness on top of the crowned rollers 81). Thus, this mounting and drive can be shared, to substantially reduce the cost of this improvement.

While the embodiment disclosed herein is preferred, it will be appreciated from this teaching that various alternatives, modifications, variations or improvements therein may be made by those skilled in the art, which are intended to be encompassed by the following claims:

What is claimed is:

1. An improved disk-type stacking system in which a disk stacking unit which is intermittently rotatable about an axis of rotation receives the lead edge area of an incoming sheet from an upstream sheet feeder in a sheet entrance path to a stacking area and then partially rotates with the received sheet lead edge area for inverting the sheet for stacking, for which the trail edge area of the sheet must be flipped over, and wherein said disk stacking unit comprises plural disks of a variable radius, substantially varying between maximum and minimum radii; the improvement comprising: a driven set of frictional drive rollers on a fixed axis of rotation, said frictional drive rollers being positioned in said sheet entrance path downstream of said upstream sheet feeder, and frictional drive rollers being generally parallel to the axis of rotation of said disk stacking unit, and said frictional drive rollers being positioned relative to said variable radius disk stacking unit for frictionally engaging only the trail edge area of a sheet for feeding the trail edge portion of the sheet forward in said sheet entrance path to assist in the flipping over of the trail edge portion of the sheet after the sheet is no longer in said upstream sheet feeder.

2. The improved disk-type stacking system of claim 1, wherein the periphery of said frictional drive rollers is inside of said maximum radius of said disk stacking unit and outside of said minimum radius of said disk stacking unit, so as to be only intermittently interdigitated with said disks.

3. The improved disk-type stacking system of claim 1, wherein said disk stacking unit has first peripheral fingers thereon defining sheet entrance slots for said receiving of the lead edge area of an incoming sheet in said disk stacking unit, and wherein said fingers are automatically interposed between said sheet lead edge and said frictional drive rollers during the initial feeding of a sheet lead edge into said sheet entrance slots by said upstream sheet feeder, and wherein said disk stacking unit has second peripheral fingers thereon, which, upon the subsequent rotation of said disk unit, underly and lift the trail edge area of that sheet into engagement with said frictional drive rollers by interdigitation therewith.

4. The improved disk-type stacking system of claim 1, wherein said frictional drive rollers are mounted on a fixed drive shaft overlying said disk stacker unit, and wherein a downwardly inclined trail edge assistance belt transport flight is closely adjacent downstream thereof for cooperation therewith.

5. The improved disk-type stacking system of claim 1, wherein said frictional drive rollers are mounted on a fixed driven shaft overlying said disk stacker unit, and wherein a downwardly inclined trail edge assistance belt transport flight is closely adjacent downstream thereof for cooperation therewith, and wherein said fixed driven shaft also supports and drives said trail edge assistance belt transport.

* * * * *